US008950334B1

(12) United States Patent
Hooke

(10) Patent No.: US 8,950,334 B1
(45) Date of Patent: Feb. 10, 2015

(54) PRE-DEFORMED OBTURATOR FOR TUBE-LAUNCHED PROJECTILE

(71) Applicant: Ryan Hooke, Bangor, PA (US)

(72) Inventor: Ryan Hooke, Bangor, PA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/079,044

(22) Filed: Nov. 13, 2013

(51) Int. Cl.
*F42B 14/02* (2006.01)

(52) U.S. Cl.
CPC ..... *F42B 14/02* (2013.01)
USPC ..... 102/526

(58) Field of Classification Search
CPC ..... F42B 14/02
USPC ..... 102/524–528
See application file for complete search history.

(56) References Cited

U.S. PATENT DOCUMENTS

| | | | | | |
|---|---|---|---|---|---|
| 271,382 | A * | 1/1883 | Vavasseur | ..... | 102/526 |
| 642,762 | A * | 2/1900 | Stubbs | ..... | 102/526 |
| 2,982,550 | A * | 5/1961 | Francis | ..... | 473/569 |
| 3,439,620 | A * | 4/1969 | Bailey et al. | ..... | 102/527 |
| 4,040,359 | A * | 8/1977 | Blajda et al. | ..... | 102/527 |
| 5,027,711 | A * | 7/1991 | Schleicher et al. | ..... | 102/521 |
| 6,295,934 | B1 * | 10/2001 | Tepera et al. | ..... | 102/525 |
| 6,453,821 | B1 * | 9/2002 | Fowler et al. | ..... | 102/527 |
| 7,040,237 | B2 * | 5/2006 | Tilling et al. | ..... | 102/524 |

* cited by examiner

*Primary Examiner* — Reginald Tillman, Jr.
(74) *Attorney, Agent, or Firm* — Henry S. Goldfine

(57) ABSTRACT

A pre-deformed obturator for a projectile launched from a rifled tube includes an annular ring with a forward planar surface normal to the central longitudinal axis of the obturator. A top cylindrical surface extends aft from the forward planar surface and normal to the forward planar surface. A plurality of projections are formed on the top cylindrical surface and are configured to engage the rifling of the tube. An opening is formed in an aft end of each of the plurality of projections for receiving propellant gas. The opening may also be contiguously formed in the aft surface of the obturator radially inward of each projection. Propellant gas enters the openings in the aft of the obturator and expands the obturator to provide an efficient gas seal.

16 Claims, 6 Drawing Sheets

PRE-DEFORMED OBTURATOR FOR TUBE-LAUNCHED PROJECTILE

STATEMENT OF GOVERNMENT INTEREST

The inventions described herein may be manufactured, used and licensed by or for the United States Government.

BACKGROUND OF THE INVENTION

The invention relates in general to tube-launched projectiles and in particular to obturators for such projectiles.

Obturators are used on tube-launched projectiles to create a gas seal. The propellant gas behind the obturator propels the projectile out of the launching tube. Slip obturators decouple the rifling effects of a rifled launch tube from the projectile. Slip obturators enable fin-stabilized munitions to be launched from rifled barrels with a minimum of barrel-induced spin or from smooth barrels with no barrel-induced spin.

Some projectiles and their obturators are designed to be launched from rifled tubes while other projectiles and their obturators are designed to be launched from smooth bore tubes. For various reasons, a smooth-bore projectile may be launched from a rifled tube. For example, a smooth-bore mortar round may be launched from a rifled mortar tube. When this occurs, an increased amount of propellant gas blows by the obturator. The increased blow-by gas decreases the energy available to propel the projectile. The increased blow-by can also harm the projectile and tube in several ways. For example, the increased blow-by gas may cause the projectile to ballot (oscillate side to side) in the launch tube. The increased blow-by gas may also overheat portions of the projectile located forward of the obturator or erode the rifling inside the launch tube.

Examples of known obturators are disclosed in U.S. Pat. No. 6,295,934 issued on Oct. 2, 2001; U.S. Pat. No. 6,981,450 issued on Jan. 3, 2006; U.S. Pat. No. 5,164,540 issued on Nov. 17, 1992; U.S. Pat. No. 3,760,636 issued on Sep. 25, 1973; U.S. Pat. No. 3,910,194 issued on Apr. 25, 1973; U.S. Pat. No. 6,419,235 issued on Jul. 16, 2002; WIPO publication WO2010025891 published on Mar. 11, 2010; U.S. Pat. No. 2,846,281 (piston ring) issued on Aug. 5, 1958; and European Patent Office publication EP0046888 published on Mar. 10, 1982.

A need exists for an improved obturator for projectiles that are muzzle-loaded and launched from rifled tubes.

SUMMARY OF INVENTION

One aspect of the invention is a pre-deformed slip obturator for a projectile launched from a rifled tube. The projectile has an obturator slot with a forward planar surface normal to a central longitudinal axis of the projectile. The obturator includes an annular ring. The annular ring has a forward planar surface normal to a central longitudinal axis of the obturator and a top cylindrical surface extending aft from the forward planar surface and normal to the forward planar surface. A plurality of projections are formed on the top cylindrical surface of the annular ring. The projections are circumferentially equally-spaced around the top cylindrical surface and configured to engage the rifling of the tube. An opening is formed in an aft end of each of the plurality of projections for receiving propellant gas.

Each projection may include a pair of opposing lateral side surfaces. One lateral side surface is a bearing side that engages the rifling in the tube. The other lateral side surface is a chamfer that extends from a top surface of the projection laterally outward to the top cylindrical surface of the annular ring. The chamfer forms an angle with respect to a normal from the top cylindrical surface. The angle is in a range of zero degrees to about forty-five degrees.

Each projection may include a central longitudinal axis. The lateral side surfaces of each projection may be parallel to the central longitudinal axis of the projection. The axial length of each projection may be greater than or equal to the axial length of the top cylindrical surface.

A plurality of openings may be formed in the aft surface of the annular ring. Each of the plurality of openings may be contiguous with a respective opening in the aft end of each projection.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A novel pre-deformed slip obturator for a projectile enables the projectile to be launched from a rifled tube with less blow-by gas compared to known obturators. The slip obturator may decouple from the projectile most of the slip obturator's rotational torque. While the projectile may be breech loaded or muzzle loaded in the rifled tube, the novel slip obturator is primarily for use with muzzle-loaded projectiles. The amount of slip of the obturator may be adjusted to enable use of the obturator with both fin-stabilized and spin-stabilized projectiles. The obturator may remain attached to the projectile after the projectile exits the launch tube muzzle. Or, the obturator may separate from the projectile after muzzle exit. To enable separation of the obturator at muzzle exit, stress concentrations may be formed in the obturator and/or the obturator may be fabricated from certain materials.

The obturator may be made of, for example, metal, composite materials, plastics, woods, rubber, or organic materials. The material of the obturator must be able to elastically or plastically deform to fill voids through which gas may flow. The elongation of the material may be, for example, from about 1% to about 500%. The hardness of the material may be in a range of about Shore A 40 to about Shore D 100 and, for metals, in a range of about Brinell 30 to about Brinell 300.

The obturator may be located in a conventional obturator slot of a known projectile. The obturator slot may be located anywhere on the projectile that is forward of the projectile's propellant system. The forward surface of the obturator couples or bears on the projectile such that the force of the propellant gases aft of the obturator results in axial displacement of the projectile towards the muzzle of the launch tube. The obturator may be used with any caliber of projectile.

Figure 1:
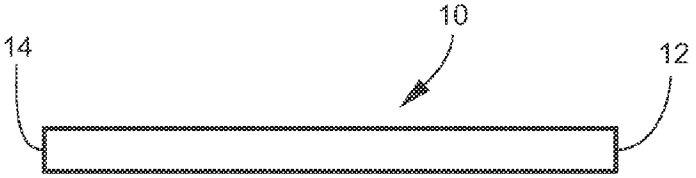
Fig. 1 PRIOR ART
FIG. 1 is a schematic side view of a projectile launch tube.
Figure 2:
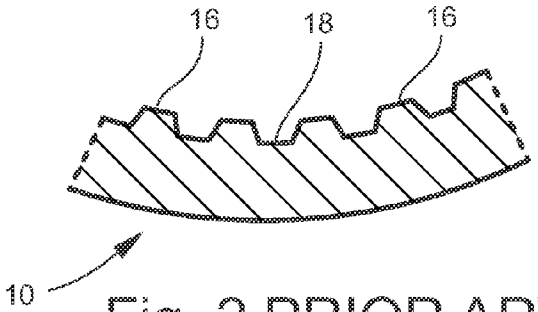
Fig. 2 PRIOR ART
FIG. 2 is an enlarged transverse sectional view of a portion of the tube of FIG. 1.
Figure 3:
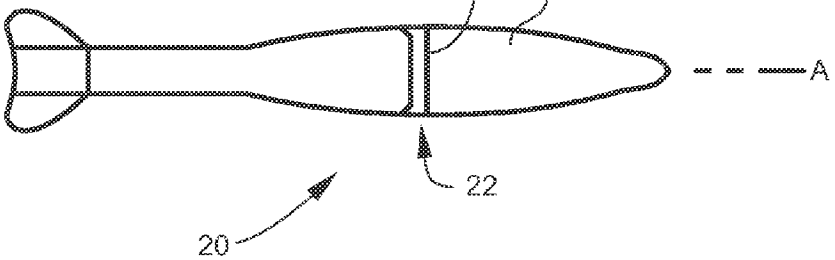
Fig. 3 PRIOR ART
FIG. 3 is a schematic side view of one embodiment of a smooth-bore projectile.
Figure 4:
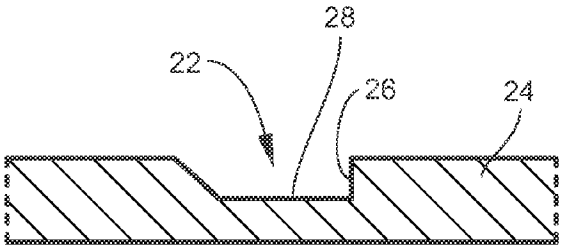
Fig. 4 PRIOR ART
FIG. 4 is an enlarged transverse sectional view of a portion of the projectile of FIG. 3.

FIG. 1 is a schematic side view of a projectile launch tube 10 having a muzzle 12 and a breech 14. Tube 10 includes rifling formed therein. FIG. 2 is a schematic transverse sectional view of a portion of tube 10 showing the rifling lands 16 and rifling grooves 18 formed in the interior of tube 10. FIG. 3 is a schematic side view of one embodiment of a smoothbore projectile 20 that may be launched from tube 10. Projectile 20 has a central longitudinal axis A and an obturator slot 22 formed on the exterior of its body 24. FIG. 4 is an enlarged view of slot 22. Slot 22 includes a forward planar surface 26. Planar surface 26 is normal to axis A of projectile 20. Slot 22 includes a bottom planar surface 28 normal to forward planar surface 26.

Figure 6:
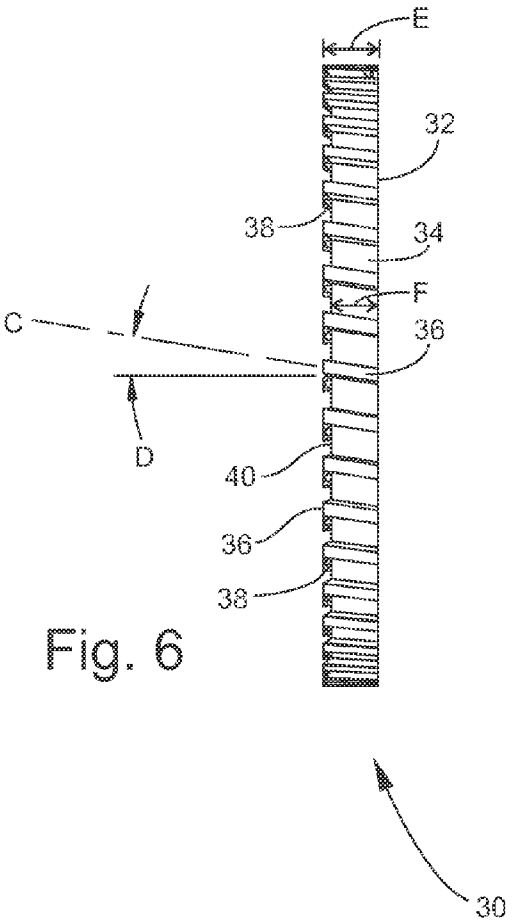
FIGS. 5, 6 and 7 are front, side and rear views, respectively, of one embodiment of a pre-deformed obturator.
Figure 5:
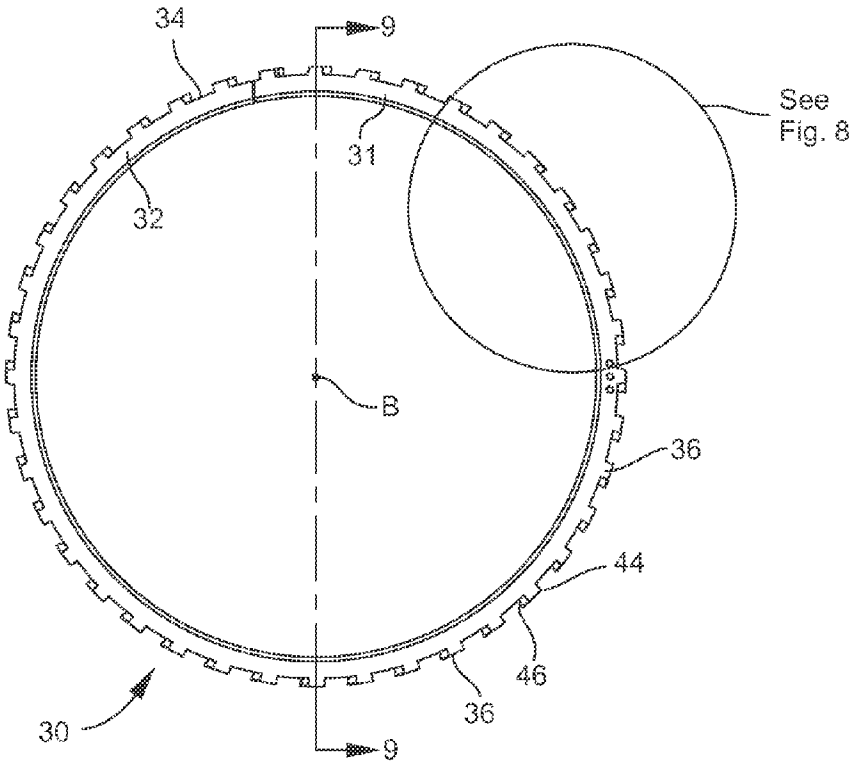
Figure 8:
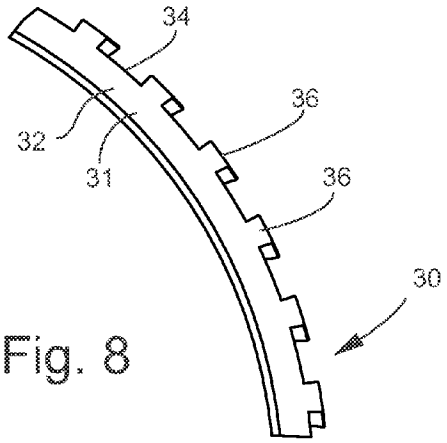
FIG. 8 is an enlarged view of a portion of FIG. 5.
Figure 7:
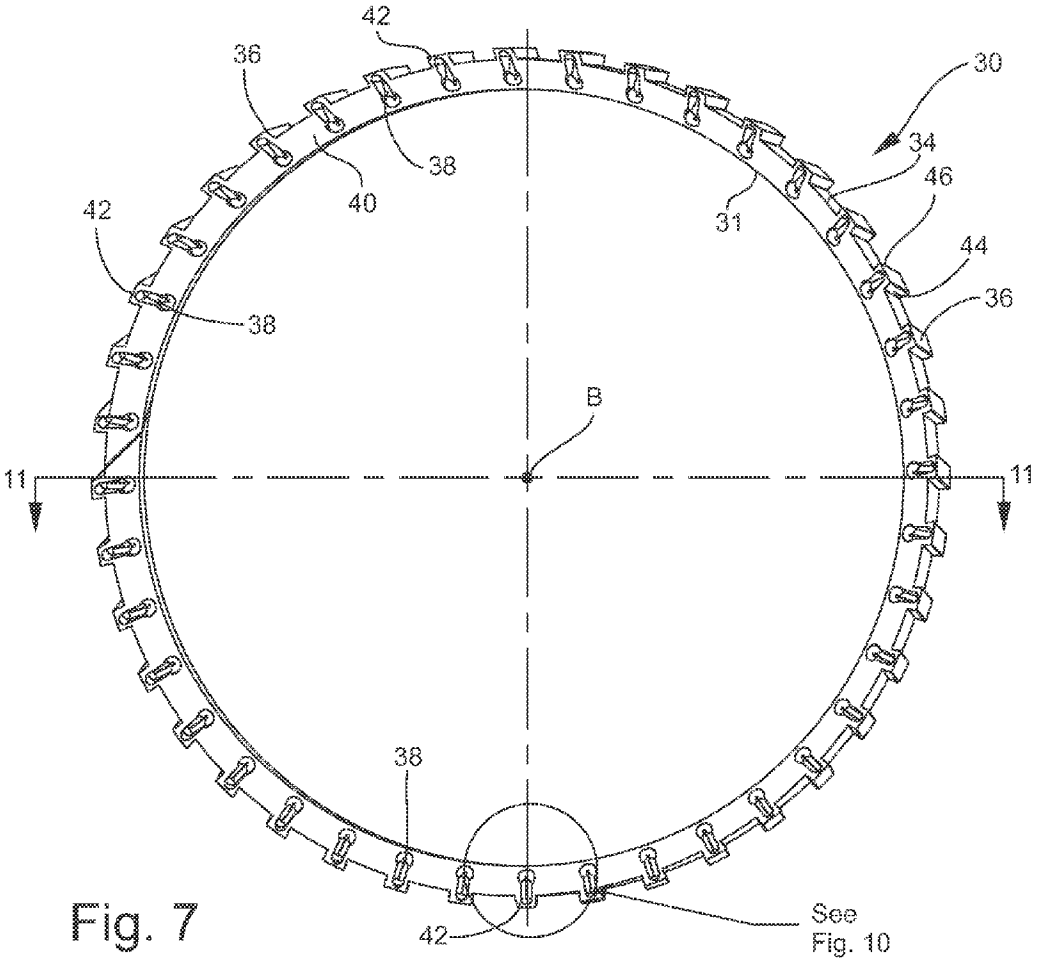

FIGS. 5, 6 and 7 are front, side and rear views, respectively, of one embodiment of a pre-deformed obturator 30. Obturator 30 is a generally annular ring or a combination of ring segments assembled into a ring 31 having a forward-facing planar surface 32 (FIG. 5) that is normal to the central longitudinal axis B of obturator 30. When projectile 20 is launched, forward planar surface 32 of ring 31 bears on forward planar surface 26 of obturator slot 22. A top cylindrical surface 34 of ring 31 extends aft from and normal to forward planar surface 32. A plurality of projections 36 are formed on top cylindrical surface 34. Projections 36 are circumferentially equally-spaced around top cylindrical surface 34 and configured to engage lands 16 (FIG. 2) and grooves 18 of tube 10 upon launch of projectile 20.

The clearance between the inside diameter of ring 31 and the bottom surface 28 of obturator slot 22 is one factor that determines the amount of torque transferred from obturator 30 to projectile 20. To decouple the torque, the clearance may be in a range of about 0.01% to about 0.04% of the bore diameter of tube 10. To couple the torque, the clearance may be in a range of no clearance to an interference fit of 0.001%-0.2% of the bore diameter.

Each projection 36 has a longitudinal axis C (FIG. 6) that may be aligned with the twist of rifling in tube 10 in a known manner. For example, angle D between axis C and a line parallel to axis B may be in range of about 4 degrees to about 13 degrees. The axial length E of each projection 36 may be more or less than the axial length F of top cylindrical surface 34. In the embodiment shown, axial length E of projections 36 is more than axial length F.

Figure 10:
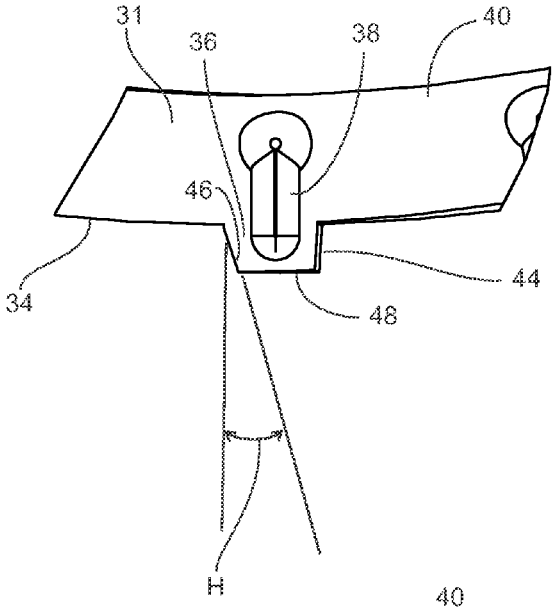
FIG. 10 is an enlarged view of a portion of FIG. 7.
Figure 11:
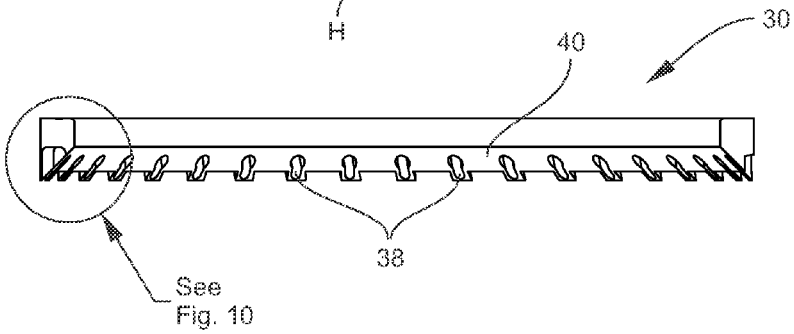
FIG. 11 is a sectional view along the line 11-11 of FIG. 7.
Figure 12:
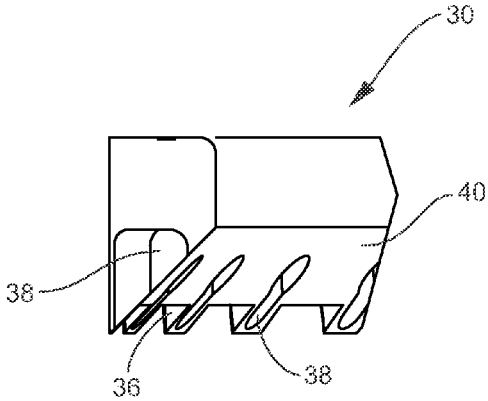
FIG. 12 is an enlarged view of a portion of FIG. 11.

Each projection 36 may include an opening 38 (FIG. 7) formed in its aft end 42. As shown in FIGS. 7, 10, 11, and 12, opening 38 may also be formed in the aft surface 40 of ring 31. FIG. 10 is an enlarged view of an opening 38. The central longitudinal axis or plane of symmetry of each opening 38 is preferably parallel to axis C (FIG. 6) of each projection 36, or, if not parallel, within about plus or minus ten degrees of parallel. Opening 38 does not extend completely through projection 36 or ring 31 because opening 38 receives propellant gas which expands obturator 30 and increases the gas sealing ability of obturator 30 when needed. Opening 38 may be centrally located in projection 36 or may be offset to one side. Openings 38 may include features such as, for example, drill points, rounded corners, flat bottoms, etc. The depth of openings 38 may vary asymmetrically or symmetrically about axis A or be combined with stress concentrations if obturator 30 is required to separate from projectile 20 after muzzle exit.

Figure 9:
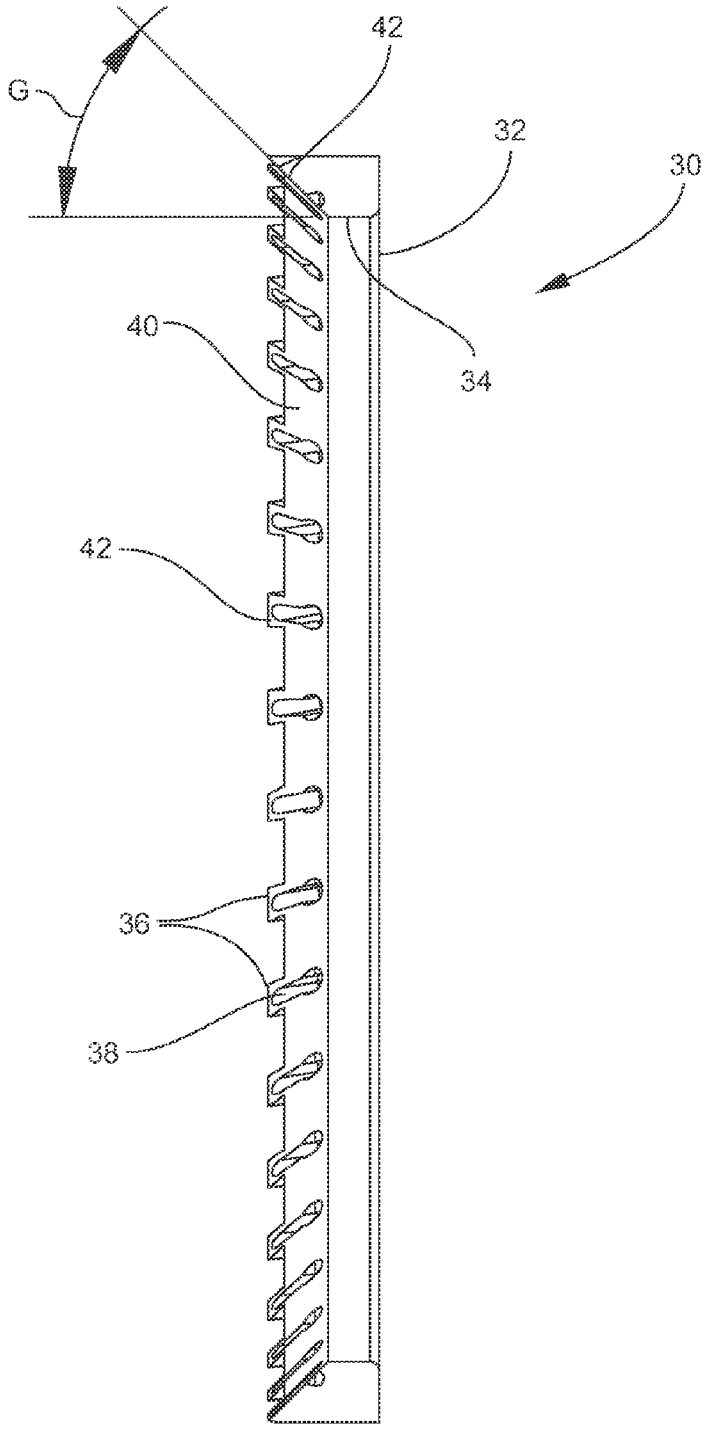
FIG. 9 is a sectional view along the line 9-9 of FIG. 5.

Referring to FIG. 9, the aft end 42 of each projection 36 may be a chamfer that forms an acute angle G with top cylindrical surface 34. Or, aft end 42 may be normal to top cylindrical surface 34.

Referring to FIG. 10, each projection 36 includes a pair of opposed lateral side surfaces 44, 46. The lateral side surfaces 44, 46 may, but need not, lie in planes that are parallel to axis C (FIG. 6). For example, the lateral side surfaces 44, 46 may not be parallel to each other or to axis C for purposes such as controlling gas flow, barrel wear, drop rates, and friction. One lateral side surface 44 may be a bearing side surface that initially engages lands 16 (FIG. 2) in tube 10. In one embodiment, the bearing side surface is angled, with respect to obturator axis B, the same as the twist of the rifling in tube 10. As shown in FIG. 10, the other side lateral side surface 46 may be a chamfer that extends from a top surface 48 of projection 36 laterally outward to top cylindrical surface 34 of annular ring 31. The chamfer angle H with respect to a normal from the base of projection 36 may be in a range of zero degrees to about forty-five degrees. The chamfer of lateral side surface 46 (and/or surface 44) may also be used to control gas flow, barrel wear, drop rates, and friction.

In the embodiment of FIG. 10, the chamfer of side surface 46 will direct the initial propellant gas wash along the side surface 46 and thereby force opposite side surface 44 to initially bear against a land 16. Thus, the side of lands 16 in tube 10 that are adjacent to side surface 46 will bear the brunt of the erosive propellant gas and the side of lands 16 in tube 10 that are adjacent to side surface 44 will be relatively uneroded, thereby providing a smoother contact surface for lateral bearing side surface 44 of obturator 30.

Figure 13:
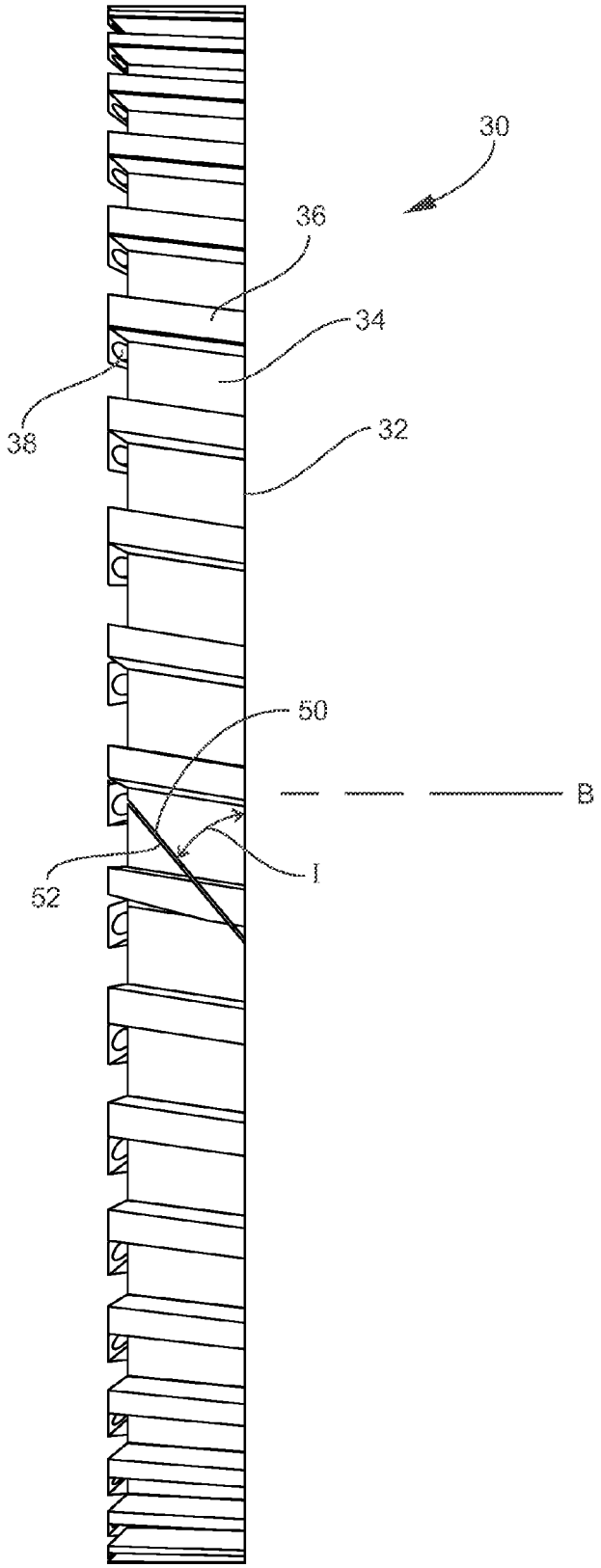
FIG. 13 is another side view of the obturator of FIG. 5.

FIG. 13 is another side view of obturator 30 showing mating free ends 50, 52 of obturator 30. Free ends 50, 52 enable obturator 30 to elastically expand or flex to fit over projectile body 24 (FIG. 3) and then to contract or compress to fit in obturator slot 22. Ends 50, 52 may be angled with respect to axis B of obturator 30. For example, angle I between free end 50 and forward planar surface 32 of ring 31 may be in a range of about three degrees to about eighty-five degrees.

While the invention has been described with reference to certain embodiments, numerous changes, alterations and modifications to the described embodiments are possible without departing from the spirit and scope of the invention as defined in the appended claims, and equivalents thereof.

What is claimed is:

1. A pre-deformed slip obturator for a projectile launched from a tube having rifling therein, the projectile including an obturator slot having a forward planar surface normal to a central longitudinal axis of the projectile, the pre-deformed slip obturator comprising;

an annular ring having a forward planar surface normal to a central longitudinal axis of the slip obturator and a top cylindrical surface extending aft from the forward planar surface and normal to the forward planar surface;

a plurality of projections formed on the top cylindrical surface, the projections being circumferentially equally-spaced around the top cylindrical surface and configured to engage the rifling of the tube; and an opening formed in an aft end of each of the plurality of projections for receiving propellant gas.

2. The obturator of claim 1, wherein each projection includes a pair of opposing lateral side surfaces, one lateral side surface being a bearing side that engages the rifling in the tube and the other lateral side surface being a chamfer that extends from a top surface of the projection laterally outward to the top cylindrical surface of the annular ring, the chamfer forming an angle with respect to a normal from the top cylindrical surface, the angle being in a range of zero degrees to about forty-five degrees.

3. The obturator of claim 1, wherein the projectile is a muzzle-loaded projectile.

4. The obturator of claim 2, wherein each projection includes a central longitudinal axis and the lateral side surfaces of each projection are parallel to the central longitudinal axis of the projection.

5. The obturator of claim 2, wherein an axial length of each projection is greater than or equal to an axial length of the top cylindrical surface.

6. The obturator of claim 2, further comprising a plurality of openings in an aft surface of the annular ring, each of the plurality of openings being contiguous with a respective opening in the aft end of each projection.

7. The obturator of claim 6, wherein the openings in the aft surface and in the aft ends of the projections do not extend completely through the aft surface and the projections, respectively.

8. The obturator of claim 7, wherein an aft end of each projection forms an acute angle with the top cylindrical surface.

9. The obturator of claim 8, further comprising a pair of mating free ends.

10. A pre-deformed obturator for a projectile launched from a tube having rifling therein, the projectile including an obturator slot having a forward planar surface normal to a central longitudinal axis of the projectile, the pre-deformed obturator comprising;

an annular ring having a forward planar surface normal to a central longitudinal axis of the obturator and a top cylindrical surface extending aft from the forward planar surface and normal to the forward planar surface;

a plurality of projections formed on the top cylindrical surface, the projections being circumferentially equally-spaced around the top cylindrical surface and configured to engage the rifling of the tube;

an opening formed in an aft end of each of the plurality of projections for receiving propellant gas; and a plurality of openings formed in an aft surface of the annular ring, each of the plurality of openings being contiguous with a respective opening in the aft end of each projection;

wherein each projection includes a pair of opposing lateral side surfaces, one lateral side surface being a bearing side that engages the rifling in the tube and the other lateral side surface being a chamfer that extends from a top surface of the projection laterally outward to the top cylindrical surface of the annular ring, the chamfer forming an angle with respect to a normal from the top cylindrical surface, the angle being in a range of zero degrees to about forty-five degrees.

11. The obturator of claim 10, wherein the projectile is a muzzle-loaded projectile.

12. The obturator of claim 11, wherein each projection includes a central longitudinal axis and the lateral side surfaces of each projection are parallel to the central longitudinal axis of the projection.

13. The obturator of claim 12, wherein an axial length of each projection is greater than or equal to an axial length of the top cylindrical surface.

14. The obturator of claim 13, wherein the openings in the aft surface and in the aft ends of the projections do not extend completely through the aft surface and the projections, respectively.

15. The obturator of claim 14, wherein an aft end of each projection forms an acute angle with the top cylindrical surface.

16. The obturator of claim 15, further comprising a pair of mating free ends.

* * * * *